United States Patent [19]

Hamilton

[11] Patent Number: 4,869,321

[45] Date of Patent: Sep. 26, 1989

[54] METHOD OF PLUGGING OPENINGS IN WELL CONDUITS

[75] Inventor: Billy E. Hamilton, Marrero, La.

[73] Assignee: Camco, Incorporated, Houston, Tex.

[21] Appl. No.: 308,485

[22] Filed: Feb. 10, 1989

[51] Int. Cl.[4] ..... E21B 33/13

[52] U.S. Cl. ..... 166/277; 166/291; 166/292; 166/309

[58] Field of Search ..... 166/277, 291, 292, 290, 166/294, 309, 313

[56] References Cited

U.S. PATENT DOCUMENTS

| | | | |
|---|---|---|---|
| 1,548,012 | 7/1925 | Dunn | 166/277 |
| 2,308,072 | 1/1943 | Granger | 166/277 X |
| 2,402,588 | 6/1946 | Andresen | 166/291 X |
| 3,381,748 | 5/1968 | Peters et al. | 166/277 |
| 3,884,302 | 5/1975 | Messenger | 166/291 |
| 4,460,045 | 7/1984 | Elson et al. | 166/309 X |
| 4,470,462 | 9/1984 | Hutchison | 166/292 |
| 4,627,496 | 12/1986 | Ashford et al. | 166/292 |
| 4,662,448 | 5/1987 | Ashford et al. | 166/290 |
| 4,754,810 | 7/1988 | Bennett et al. | 166/277 X |

*Primary Examiner*—George A. Suchfield

*Attorney, Agent, or Firm*—Fulbright & Jaworski

[57] ABSTRACT

Thread leaks, small holes, and leaks around packers in well casings and production tubing are repaired by applying a compressed foam mixture which includes discrete solid particles of various sizes for forcing the suspended particles into the opening to provide a high friction seal. The foam mixture is moved along the inside of the conduit sandwiched between fluid bodies for maintaining the foam mixture intact. Back pressure is applied to the foam mixture for aiding the mixture to be forced through the openings.

14 Claims, 2 Drawing Sheets

METHOD OF PLUGGING OPENINGS IN WELL CONDUITS

BACKGROUND OF THE INVENTION

Oil and/or gas well conduits such as casings or production tubing frequently have undesired openings such as holes in the conduit walls, thread leaks at the threaded joints, or leaks across a well packer. Various methods have been developed to repair and close these openings while the well conduits remain in place. However, various of the repair methods required knowledge of the specific location of the opening and/or require the repair job to be completed within certain time constraints.

The present invention is directed to an improved method for repairing and plugging openings in well conduits in which the need to locate the specific position of the leak or opening in the well conduit is not required and in which the method need not be performed within certain time constraints, but may be continued until the leak is repaired.

SUMMARY

The present invention is directed to a method of plugging an opening in the wall of a first conduit in a well having a second conduit positioned generally coaxially with the first conduit and communicating with the first conduit. The method includes injecting a first fluid body down the inside of one of the conduits, thereafter injecting a foam mixture of a gas, foaming agent, liquid, and discrete solid particles of various sizes down the inside of the one conduit, and thereafter injecting a second fluid body down the inside of the one conduit. The fluid bodies sandwich the foam mixture and isolate it from dispersal in the other well fluids. The method includes moving the mixture under pressure along the inside of the first conduit for forcing particles into and closing the opening with a high friction seal. The fluids in the one conduit which are displaced by the insertion of the fluids and mixture are transmitted to the other conduit and are adjustably choked for maintaining the desired back pressure on the gases and the mixture for closing the openings. After plugging the opening, fluid is injected for flushing the mixture out of the conduits.

Still a further object is wherein the fluids are gases and preferably nitrogen, the foam mixture preferably has a ratio of approximately 85% gas and 15% liquids, and preferably the solid particles are plastic.

Yet a further object is wherein one of the conduits is a well casing and the other of the conduits is a well production tubing and including the step of blocking fluid flow out of the bottom of the production tubing.

Still a further object is wherein one of the conduits is a well production tubing and the second conduit is a coil tubing and includes the step of blocking fluid flow out of the bottom of the production tubing.

Still a further object of the present invention is the method of plugging an opening in the wall of a casing in a well having a production tubing positioned inside of the casing with the production packer therebetween and an openable port in the production tubing above the packer. The method includes setting a fluid blocking plug in the production tubing below the port, opening the port for providing communication between the casing and the production tubing, and sequentially injecting a first fluid, a foam mixture including discrete solid particles and a second fluid body down the inside of the casing. The mixture is moved under pressure down the inside of the casing for forcing particles in the foam into and closing the opening while choking the flow out of the top of the tubing for maintaining a back pressure on the mixture.

Still a further object is the provision of a method of plugging an opening in the well of a production tubing in a well in which the tubing is positioned inside a well casing with a production packer therebetween and an openable port in the production tubing above the packer. The method includes setting a fluid blocking plug in the tubing below the port, and opening the port between the casing and the production tubing. The method includes sequentially injecting a first fluid body, a foam mixture containing discrete solid particles of various sizes, and a second fluid body down the inside of the tubing. The mixture is moved down the inside of the tubing for forcing particles into and closing the opening while choking the flow out of the top of the casing for maintaining back pressure on the mixture.

Yet a further object is the provision of a method of plugging a leak about a production packer positioned between the well casing and the production tubing and above casing perforations. The method includes injecting particles of sand down a coil tubing through the production tubing to cover and protect the perforations and thereafter sequentially injecting a first fluid body, a foam mixture containing discrete solid plastic particles of various sizes and a second fluid body down the coil tubing and moving the mixture under pressure against the bottom of the packer for forcing the particles into and closing the opening. Thereafter, the unused mixture and the sand are removed from the well.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

Figure 1:
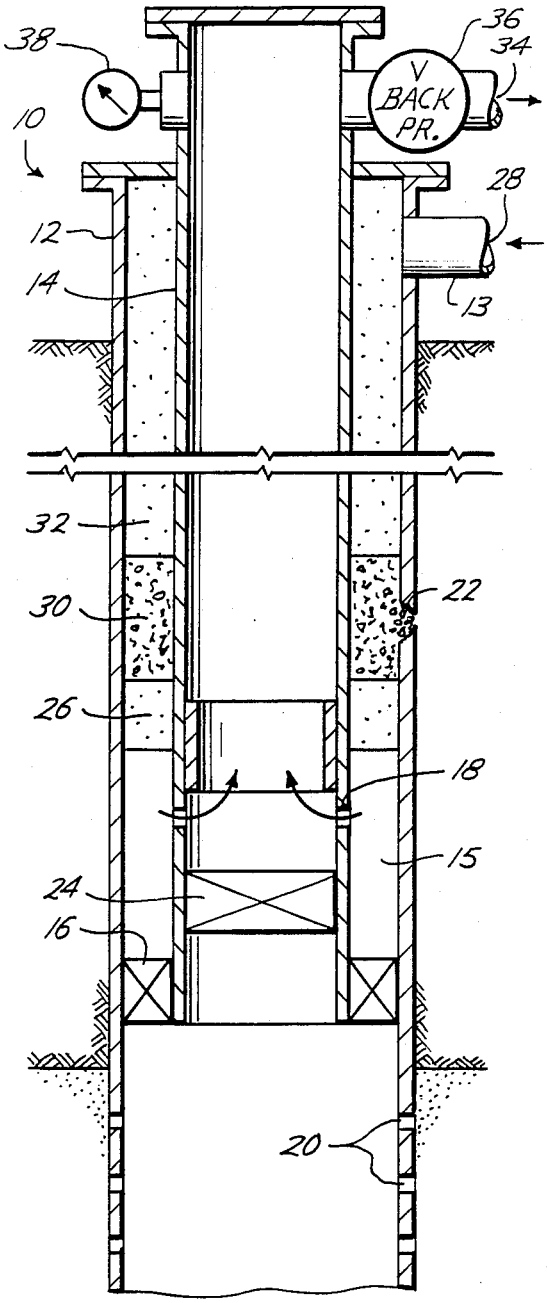
FIG. 1 is a schematic elevational view of plugging an opening in the casing in a well.

Referring now to the drawings, and particularly to FIG. 1, an oil and/or gas well installation is shown generally by the reference numeral 10 and includes a conventional casing 12, well production tubing 14 which is generally positioned coaxially inside of the casing 12, and a production packer 16 sealing off the annulus 15 between the casing and production tubing 14. The production tubing 14 also generally includes a circulating port 18 which is normally closed but is openable and may be any suitable openable port, such as a sliding sleeve valve, or a conventional sidepocket mandrel. In normal operations, oil and/or gas is produced through perforations 20 in the casing 12 and the well production flows upwardly through the production tubing 14 to the well surface.

However, sometimes a leak occurs, such as an opening 22, in the wall of the casing 12, usually by corrosion. The present invention is directed to a method of plugging the leak 22 by moving a compressed foam mixture which includes suspended solid particles of various sizes along the wall of the casing 12, thereby forcing the suspended particles into the leak 22 to provide a high efficient seal. The present method of plugging the leak does not require that the specific location of the leak 22 need to be determined as the compressed foam mixture is moved along the inside wall of the casing 12 and is therefore able to plug one or even more leaks positioned at various locations in the wall of the casing 12. Furthermore, the method of the present invention does not require the use of chemical reacting ingredients which require certain time constraints on their use. Instead, the present method is substantially unlimited as to working time so long as the foam remains in substantial suspension. The present invention is directed to applying the compressed body of foam mixture against the wall of the well conduit in a direction in which normal pressure forces act on the wall so as to maintain the plugged particles in place. That is, the foam mixture is directed down the inside of the casing 12 for plugging the leaks 22 from the inside towards the outside as that is the normal direction from which well pressures may occur and therefore any normal work pressures will act to keep the plugged particles in place.

In order to force a compressed body of foam mixture against the leak opening 22, a fluid path is set up in which the compressed foam mixture may be applied against a choke for providing a back pressure for applying pressure to the foam mixture. Therefore, fluid blocking means, such as a blanking plug or bridge plug 24, is provided in the production tubing 14 below the circulating port 18 for blocking fluid flow out of the bottom of the production tubing 14. Thereafter, the circulating port 18 is opened. This provides communication between the casing annulus and the inside of the production tubing 14. The blanking plug 24 also prevents the foam mixture from being applied to the perforations 20 and thereby damaging the well production.

The method includes injecting a first fluid body 26 down the inside of the casing 12 between the casing 12 and the production tubing 14 through an injection port 28. Thereafter, a foam mixture, including a gas, foaming agent, liquid, and discrete solid particles of various sizes are injected through the injection port 28 down the inside of the casing 12 on top of the first gas body 26. In one satisfactory tested installation ten gallons of a sealer containing discrete solid particles of various sizes sold under the trademark "Hyposeal" was mixed in a 1:4 ratio with water. That is, ten gallons of Hyposeal were mixed with 40 gallons of water and then combined with two gallons of a foaming agent such as an anionic surfactant. The liquid mixture was injected into the annulus with gas by an atomizer such as Model 315 used by NowCam Services, a division of Camco, Incorporated, to produce the foam mixture. The foam was formed with substantially a 6:1 ratio between the gas, and the liquid. While the discrete solid particles may be of various types, they should be of various sizes to coact with and become stuck under pressure in the leak hole 22. For example only, the particles may be plastic particles such as sold under the trademark Teflon and may be in various shapes, such as angel hair and non-uniform plugs. Thereafter, a second fluid body 32 is injected through the injection port 38 on top of the foam mixture 30. While the fluids 26 and 32 may be any suitable liquid or gas, such as air, preferably they are gases such as nitrogen. The first fluid body 26 may be a liquid such as water.

Pressure is applied to the top of the gas body 32 moving the mixture 30 down the inside of the casing 12 for forcing particles therein into and closing the opening 22. Preferably, the pressure is maintained at a high pressure for forcing the solid particles into the opening 22 to provide a high friction seal, but at the same time not overpressuring the casing 12. It is to be noted that the first gas body 26 and the second gas body 32 maintain the foam mixture 30 in suspension therebetween and prevent its dissolution with well fluids existing in the casing annulus. In addition they provide a compressed gas on either side for providing energy for compressing the foam 30 against the leak 22. The well fluids in the annulus between the casing 12 and tubing 14 are displaced by the insertion of the gases 26 and 32 and mixture 30 and the well fluids move through the openable port 18 into the production tubing 14 and flow out of the exit 34 of the tubing 14. A choke, preferably an adjustable choke 36, is provided in the production tubing 14 for choking the flow for maintaining a back pressure on the foam mixture 30 which is measured by the pressure gauge 38.

After the leak or opening 22 is plugged, the mixture 30 is flushed from the production tubing 14 and casing 12. Preferably, fluid, such as water, is injected down the production tubing 14 through the top opening 34 for moving the mixture 30 up and out of the casing 12 through the injection port 28. The movement of the foam mixture 30 downwardly by the opening 22 and also upwardly past the opening 22 allows additional opportunities to seal any leaks. If there is any evidence that a leak still exists, the mixture 30 may again be moved downwardly and upwardly pass the opening 22. Of course, if desired, the mixture 30 may be flushed out by injecting a fluid down the annulus 15, through port 18, up tubing 14 and out the opening 34.

The method of the present invention may be utilized in repairing or plugging small holes in other well conduits, such as production tubing, sealing thread leaks in conduit joints, and sealing leaks around well packers.

Figure 2:
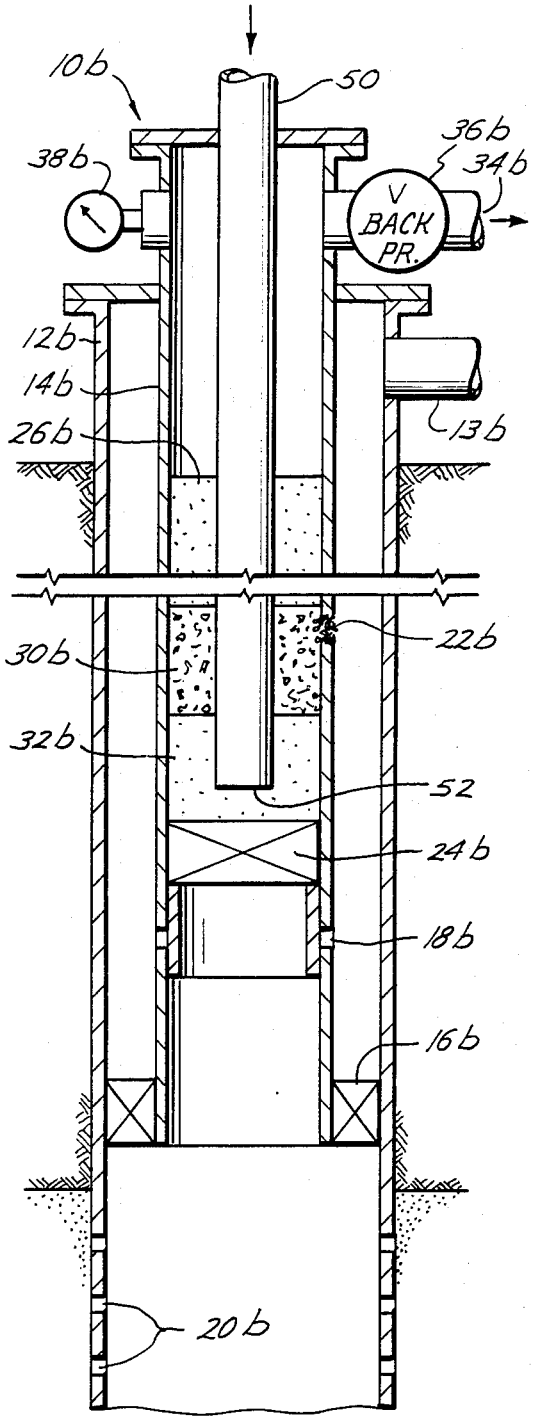
FIG. 2 is a schematic elevational view illustrating the method of the present invention of plugging an opening in the production tubing with the aid of coil tubing.

Referring now to FIG. 2, another well installation **10*b* is shown, in which it is desired to plug or repair an opening 22*b* in the production tubing 14*b* which is connected to a production packer 16*b* and positioned coaxially in a casing 12*b*. In the installation of FIG. 2, the circulating port 18*b* may be considerably lower in the well than the leak 22*b* and/or it may be desirable to use less materials in performing the method. A blocking fluid means 24*b* is first installed in the production tubing 14*b* for preventing contamination of the well formation by the foam mixture and the port 18*b* remains closed. A vent 13*b* in the casing 12*b* is opened. In the method of FIG. 2, a first fluid or gas body 26*b* is injected down the inside of a coil tubing 50 followed by a foam mixture 30*b*, and a second fluid or gas body 32*b*. Coil tubing is a continuous conduit without joints carried on a reel which can be lowered into production tubing and generally is of a small diameter such as 1 to 1½ inches. The first gas body 26*b*, the foam mixture 30*b* and the second gas body 32*b* is injected through the coil tubing 50, out its lower end 52, and into the inside of the production tubing 14b. The foam mixture 30b is moved under pressure along the inside of the production tubing 14b for forcing particles out into the opening 22b. Well fluids in the production tubing 14b are displaced out of the exit port 34b and an adjustable choke 36b connected to the tubing 14b maintains back pressure on the foam mixture 30b. After plugging the opening 22b, fluid, may be injected through the exit 34b for moving the mixture 30b up and out of the coil tubing 50. This reversal of flow may be under pressure to again contact the opening 22b with a pressure foam mixture 30b and again treat the opening 22b as it is reversed in the production tubing 14b. Of course, the mixture 30b may be flushed out by injecting a fluid, such as water, either through exit 34b or downwardly through coil tubing 50**.

Figure 3:
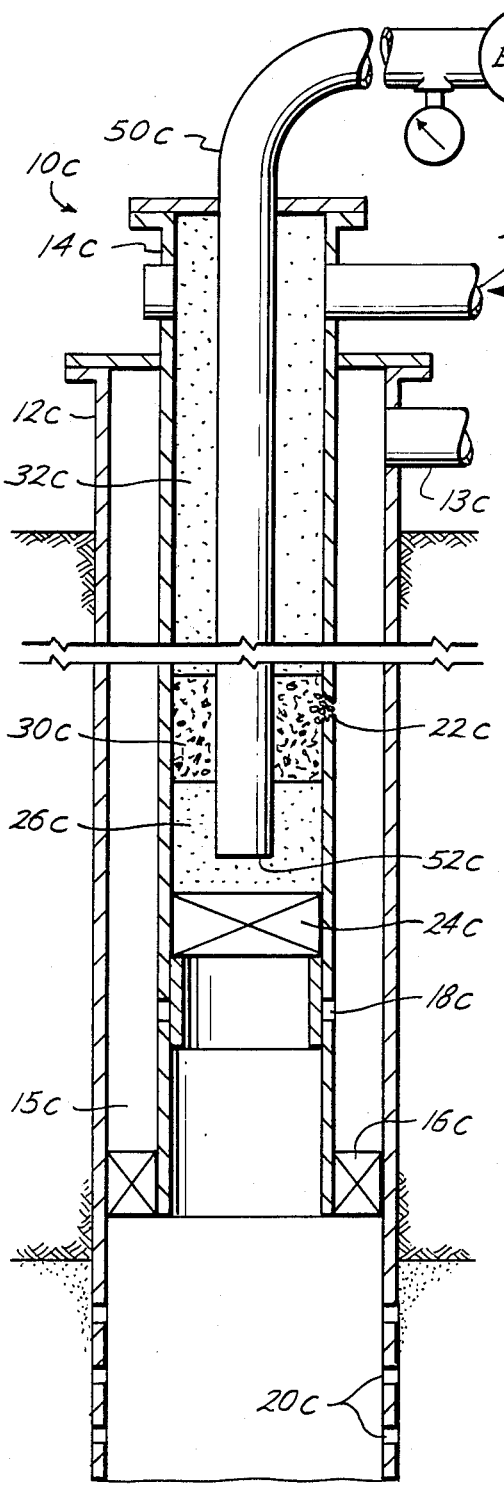
FIG. 3 is a schematic elevational view of the method of the present invention of plugging an opening in the production tubing with a coil tubing with a method different from that used in FIG. 3.

Referring now to FIG. 3, a similar well installation 10c is shown in which a leak 22c in the production tubing 14c is plugged but in which the insertion of the fluids or gases and foam material is reversed as compared to the method of FIG. 2. In the method of FIG. 3, the fluid blocking means 24c is set, the port 18c remains closed and vent 13c is opened. Thereafter, the first fluid or gas body 26c, the foam mixture 30c, and the second gas body 32c, are sequentially injected through the injection port 28c, into the inside of the tubing 14c, moved down the tubing 14c while being pressurized. Back pressure is maintained through the coil tubing 50c by the adjustable choke 36c. The foam mixture 30c is moved downwardly across the leak 22c to force the particles out into the leak 22c. After the mixture 30c is moved downwardly, it may be moved upwardly again across the opening 22c by injecting fluid, such as water, downwardly through the coil tubing 50c and thereafter moving the mixture 30c out of the tubing 14c.

Figure 4:
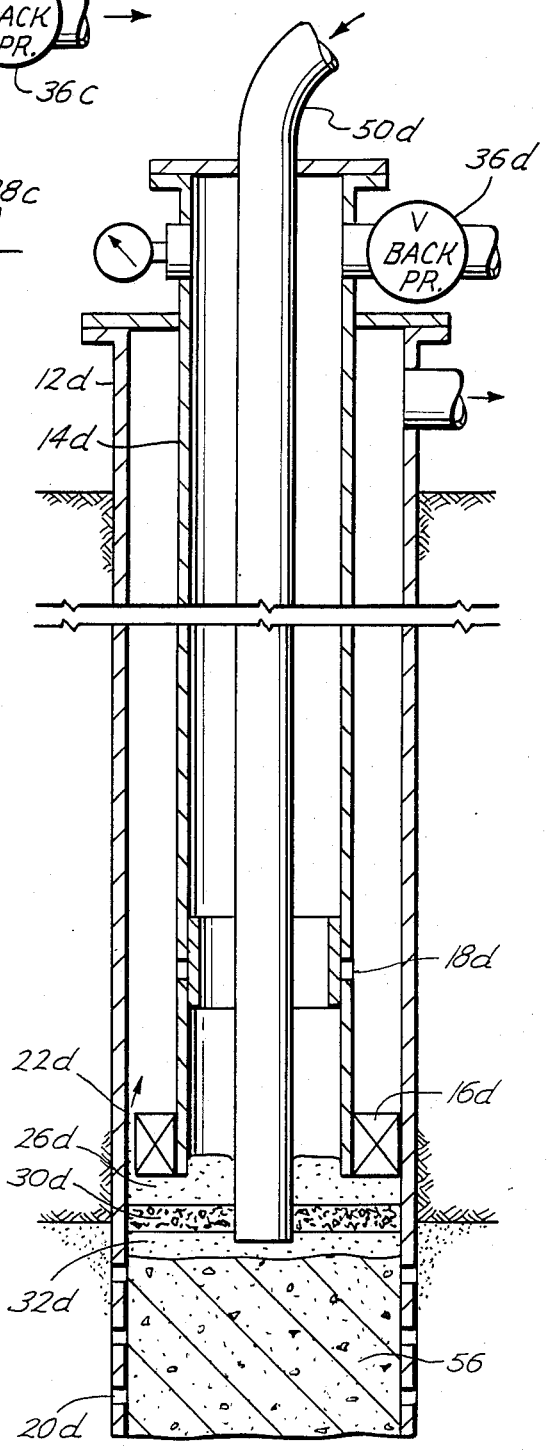
FIG. 4 is a schematic elevational view illustrating the use of the method of the present invention in plugging an opening around the well packer between the casing and the production tubing.

Referring now to FIG. 4, a well installation 10d is shown in which the leak 22d is between the well packer 16d and the casing 12d. In this case, a coil tubing 50d is utilized to seal the leak 22d. It is to be noted that in the prior embodiments, fluid seal means 24a, 24b, 24c were utilized to protect the casing perforations and thus the formation from the foam mixture as the particles therein could plug the perforations and damage the well formation. In the method of FIG. 4, a suitable material, such as sand 56, is blown down the coil tubing 50d to provide a covering over the perforations 20d for protecting them from the foam mixture. Thereafter, a first fluid or gas body 26d, a foam mixture 30d and a second gas body 32d is injected against the bottom of the well packer 16d to force portions of the first gas body 26d and the foam mixture 32d through the opening 22d thereby sealing the leak. Back pressure is maintained by virtue of an adjustable choke 36d connected to the production tubing 14d.

In one actual example, similar to FIG. 1, leaks were encountered in a 9 and $\frac{5}{8}$ inch casing having a 2 and $\frac{7}{8}$ inch production tubing. Ten gallons of Hyposeal were mixed with 40 gallons of water and then combined with two gallons of the foaming agent and mixed thoroughly. A first body of nitrogen was injected into the casing annulus and the liquid mixture was foamed through the atomizer maintaining six parts of gas to one part of liquid at 3565 psi. The foam column was moved down the inside of the $9\frac{5}{8}$ inch casing at approximately 45 linear feet per minute. When the bottom of the foam mixture reached 5900 feet, the flow was reversed, but maintaining 3000 psi on the inside of the $9\frac{5}{8}$ inch casing. Water was injected down the $2\frac{7}{8}$ inch well tubing to move the foam mixture back up the inside of the casing at approximately 40 feet per minute, and water was flowed through the casing annulus for 15 minutes to clean the foam. The casing was placed on a 3000 psi test at 15:45 of May 27 to 06:00 of May 31 and no pressure was lost during the test. Before the sealing of the leak by the present invention, the pressure would bleed from 3000 psi to 0 in 10–12 minutes.

The present invention, therefore, is well adapted to carry out the objects and attain the ends and advantages mentioned as well as others inherent therein. While presently preferred embodiments of the invention are given for the purpose of disclosure, numerous changes in the steps of the process may be made which will readily suggest themselves to those skilled in the art and which are encompassed within the spirit of the invention and the scope of the appended claims.

What is claimed is:

1. A method of plugging an opening in the wall of a first conduit in a well having a second conduit positioned generally coaxially with the first conduit and communicatable with said first conduit comprising, injecting a first fluid body down the inside of one of the conduits, thereafter injecting a foam mixture of a gas, foaming agent, liquid, and discrete solid particles of various sizes down the inside of said one conduit, thereafter injecting a second fluid body down the inside of said one conduit, moving the mixture under pressure along the inside of the first conduit for forcing particles into and closing the opening, transmitting fluid in the one conduit which is displaced by the insertion of the gases and mixture and their movement to the other conduit, choking the flow out of the other conduit for maintaining back pressure on the gases and the mixture, and after plugging the opening, flushing the mixture out of the conduits.

2. The method of claim 1 wherein the fluids are gases.

3. The method of claim 1 wherein the foam mixture is approximately 85% gas and 15% liquids.

4. The method of claim 1 wherein the first conduit is a well casing and the second conduit is a well production tubing and including the step of blocking fluid flow out of the bottom of the production tubing.

5. The method of claim 4 wherein the fluids and mixture are injected down the inside wall of the casing, and choking the flow out of the top of the production tubing.

6. The method of claim 1 wherein the first is a liquid.

7. The method of claim 1 wherein the first conduit is a well production tubing and the second conduit is a coil tubing and including the step of, blocking fluid flow out of the bottom of the production tubing.

8. The method of claim 7 wherein the fluids and mixture are injected down the inside of the coil tubing, and choking the flow out of the top of the production tubing.

9. The method of claim 7 wherein the fluids and mixture are injected down the inside wall of the production tubing, and choking the flow out of the coil tubing.

10. The method of claim 1 wherein the fluids are nitrogen gases.

11. The method of claim 1 wherein the solid particles include plastic.

12. A method of plugging a leak about a production packer positioned between the well casing and the production tubing and above casing perforations comprising, injecting particles of sand down a coil tubing through the production tubing to cover and protect the perforations, injecting a first fluid body down the inside of the coil tubing, thereafter injecting a foam mixture of a gas, foaming agent, liquid and discrete solid plastic particles of various sizes down the coil tubing through the production tubing to the bottom side of the packer, thereafter injecting a second fluid body down the coil tubing, moving the mixture under pressure against the bottom of the packer for forcing the particles into and closing the opening, and thereafter cleaning out the unused mixture and the sand from the well.

13. A method of plugging an opening in the wall of a casing in a well having a production tubing positioned inside the casing with a production packer therebetween and an openable port in the production tubing above the packer comprising, setting a fluid blocking plug in the production tubing below the port, opening the port for providing communication between the casing and the production tubing, injecting a first fluid body down the inside of the casing, thereafter injecting a foam mixture of a gas, foaming agent, liquid, and discrete solid particles of various sizes down the inside of the casing, thereafter injecting a second fluid body down the inside of said casing, moving the mixture under pressure down the inside of the casing for forcing particles into and closing the opening, transmitting fluid in the casing which is displaced by the insertion of the fluids and mixture to the production tubing through the port, choking the flow out of the top of the tubing for maintaining back pressure on the mixture, and after plugging the opening, flushing the mixture out of the casing.

14. A method of plugging an opening in the wall of a production tubing in a well in which the tubing is positioned inside a well casing with a production packer therebetween and an openable port in the production tubing above the packer comprising, setting a fluid blocking plug in the tubing below the port, opening the port for providing communication between the casing and the production tubing, injecting a first fluid body down the inside of the production tubing, thereafter injecting a foam mixture of a gas, foaming agent, liquid, and discrete solid particles of various sizes down the inside of the tubing, thereafter injecting a second fluid body down the inside of said tubing moving the mixture down the inside of the tubing for forcing particles into and closing the opening, transmitting fluid in the tubing which is displaced by the insertion of the fluids and mixture to the casing through the port, choking the flow out of the top of casing for maintaining back pressure on the mixture, and after plugging the opening, flushing the mixture out of the tubing.

* * * * *